US007240733B2

(12) United States Patent
Hayes et al.

(10) Patent No.: US 7,240,733 B2
(45) Date of Patent: Jul. 10, 2007

(54) PRESSURE-ACTUATED PERFORATION WITH AUTOMATIC FLUID CIRCULATION FOR IMMEDIATE PRODUCTION AND REMOVAL OF DEBRIS

(75) Inventors: Kirby Hayes, Lloydminster (CA); Dan St. Amant, Lloydminster (CA)

(73) Assignees: Kirby Hayes Incorporated, Lloydminster, AB (CA); Hurricane Industries Ltd, Lloydminster, SK (CA)

( * ) Notice: Subject to any disclaimer, the term of this patent is extended or adjusted under 35 U.S.C. 154(b) by 283 days.

(21) Appl. No.: 10/907,323

(22) Filed: Mar. 29, 2005

(65) Prior Publication Data

US 2005/0217854 A1 Oct. 6, 2005

Related U.S. Application Data

(63) Continuation-in-part of application No. 10/811,815, filed on Mar. 30, 2004.

(30) Foreign Application Priority Data

Nov. 18, 2004 (CA) ..... 2487878

(51) Int. Cl.
*E21B 43/11* (2006.01)
*E21B 21/14* (2006.01)

(52) U.S. Cl. ..... 166/297; 166/55.1; 166/308.6; 166/312

(58) Field of Classification Search ..... 166/308.1, 166/308.6, 297, 298, 311, 55, 55.1, 55.2, 166/177.5, 318, 319, 321, 323, 374, 332.1, 166/334.1, 334.4, 299, 312
See application file for complete search history.

(56) References Cited

U.S. PATENT DOCUMENTS 2,092,337 A 9/1937 Spencer
2,169,559 A 8/1939 Halliburton (Continued)

FOREIGN PATENT DOCUMENTS

CA 1272681 8/1990

OTHER PUBLICATIONS

Hayes, Perforating for Heavy Oil Cold Production in North West Saskatchewan and North East Alberta, Canada, 1988, http://www.lloydminsterheavyoil.com/CPperforate.htm.

(Continued)

*Primary Examiner*—Kenneth Thompson
(74) *Attorney, Agent, or Firm*—Sean Goodwin

(57) ABSTRACT

Openings are created between a wellbore and a formation by firing a perforating gun adjacent to a zone in the formation and the production fluids are produced along with any formation debris. A tubing string extending to the formation is pressurized to actuate the perforating gun and simultaneously to actuate a downhole injection port. Substantially immediately thereafter fluids are injected into the wellbore near the openings and circulated to the surface for the removal of debris and the production of the formation fluids. An optional and uphole injection port can be used to adjust the hydrostatic head above the perforating gun with the removal or addition of fluid prior to actuation. The tubing string extends sufficiently above the wellbore at surface to enable lowering of the downhole injection port below the openings during fluid circulation for enhanced removal of debris.

19 Claims, 5 Drawing Sheets

U.S. PATENT DOCUMENTS

| | | | | | |
|---|---|---|---|---|---|
| 2,330,509 | A | | 9/1943 | McCullough | |
| 2,760,408 | A | | 8/1956 | Taylor | |
| 3,559,739 | A | | 2/1971 | Hutchison | |
| 4,499,951 | A | * | 2/1985 | Vann | 166/297 |
| 4,501,292 | A | | 2/1985 | Maloblocki | |
| 4,510,797 | A | | 4/1985 | Guidry | |
| 4,541,486 | A | | 9/1985 | Wetzel | |
| 4,560,000 | A | | 12/1985 | Upchurch | |
| 4,576,236 | A | | 3/1986 | Stout | |
| 4,665,982 | A | | 5/1987 | Brown | |
| 4,667,735 | A | | 5/1987 | Salerni | |
| 4,771,635 | A | | 9/1988 | Trevillion | |
| 4,848,454 | A | | 7/1989 | Spears | |
| 4,880,056 | A | | 11/1989 | Nelson | |
| RE34,451 | E | | 11/1993 | Donovan | |
| 5,287,924 | A | * | 2/1994 | Burleson et al. | 166/297 |
| 5,301,755 | A | | 4/1994 | George | |
| 5,327,974 | A | * | 7/1994 | Donovan et al. | 166/311 |
| 5,400,856 | A | | 3/1995 | Schmidt | |
| 5,441,110 | A | | 8/1995 | Scott, III | |
| 5,443,123 | A | * | 8/1995 | Wall et al. | 166/288 |
| 5,484,022 | A | | 1/1996 | Coutts | |
| 5,505,261 | A | * | 4/1996 | Huber et al. | 166/297 |
| 5,582,250 | A | | 12/1996 | Constien | |
| 5,865,254 | A | | 2/1999 | Huber | |
| 5,888,021 | A | | 3/1999 | Kawabata | |
| 5,941,311 | A | | 8/1999 | Newton | |
| 6,173,783 | B1 | | 1/2001 | Abbott-Brown | |
| 6,336,506 | B2 | | 1/2002 | Wesson | |
| 6,554,067 | B1 | | 4/2003 | Davies | |
| 7,059,411 | B2 | * | 6/2006 | Hayes | 166/298 |
| 2001/0004937 | A1 | | 6/2001 | Leniek, Sr. | |
| 2002/0020535 | A1 | | 2/2002 | Johnson et al. | |
| 2006/0196667 | A1 | * | 9/2006 | Alba et al. | 166/308.1 |

OTHER PUBLICATIONS

Variperm Canada Limited, Model "H" Bypass Valve, Jan. 17, 2000, http://www.variperm.com/059.htm.

Integrated Production Services, Burst Plug Tubing Drain, published prior to Nov. 18, 2004.

* cited by examiner

PRESSURE-ACTUATED PERFORATION WITH AUTOMATIC FLUID CIRCULATION FOR IMMEDIATE PRODUCTION AND REMOVAL OF DEBRIS

CROSS-REFERENCE TO RELATED APPLICATIONS

This application is a continuation-in-part of U.S. application Ser. No. 10/811,815 filed Mar. 30, 2004, the entirety of which is incorporated herein by reference.

FIELD OF THE INVENTION

This invention relates to a method and apparatus to perforate or re-perforate a well and then to substantially and immediately thereafter circulate a fluid for removal of solids and debris from an underground formation for an aggressive completion or stimulation.

BACKGROUND OF THE INVENTION

To recover hydrocarbons such as oil and natural gas from subterranean formations through a wellbore penetrating the earth to the hydrocarbon-bearing formation, it is common to perform a completion, including perforating, and in some circumstances to perform some type of stimulation procedure in order to enhance the recovery of the valuable hydrocarbons.

In order to recover the hydrocarbons, a well is drilled from the surface to the formation. Following drilling, the well is generally completed by installing a tubular well casing in the open borehole and cementing the casing in place. Because the casing and cement forms a continuous hollow column, no wellbore fluids are able to enter the well, to be transported to, and to be recovered at the surface.

For this reason, it is common to provide openings through the casing and cement annulus in the zone of interest; by perforating the casing and cement into the surrounding formation to provide access from the formation into the wellbore for recovery of the formation fluids. In situations where existing perforations are deemed inadequate the formation can be stimulated using a variety of other techniques such as acidizing, fracturing, flushing, or re-perforating, any of which can result in debris.

Forms of debris include drilling or perforation debris, debris from cementing operations, and/or mud solids. Naturally occurring debris such as sand, silts or clays can also be present. In some formations shales and shale chunks, pyrites coal and other fragmented sections of formations can be produced. This debris should be quickly removed from the wellbore or formation in order to prevent it from causing a blockage, eroding or damaging production equipment. In some instances the removal of increased volume of debris can substantially enhance production.

Completion or stimulation methods include a method described in U.S. Pat. No. Re. 34,451 to Donovan et al wherein a perforating gun with an external auger is mounted to a tubing string to both aid in clean-up of the debris from the perforations as well as to facilitate the movement of the gun out of the debris. The auger flights create a tortuous path increasing the velocity of produced formation fluids and improves the ability of those fluids to carry debris. Hydrostatic kill fluid is circulated to remove debris and produced hydrocarbons. Thereafter, proppent is pumped down tubing and into the formation. The auger facilitates the removal of the gun packed in the sand.

In U.S. Pat. No. 4,560,000 to Upchurch a well perforating technique actuates a firing mechanism of a tubing-conveyed perforating gun using a pressure difference between at different points in the borehole. The technique obtains the benefit of underbalanced conditions to aid in creating a localized cleansing effect as the formation fluids enter the well casing.

Further, Applicant was part of the development of an aggressive perforating-while-foaming (PWF) production process to increase the production capability of a well. This process has gained wide usage over the last 4 years within the heavy oil industry, specifically wells drilled into unconsolidated sandstone formations. This method produced more sand in a shorter period of time than other more traditional methods. It is strongly suspected that this immediate removal of sand is linked to the superior performance of these wells. A perforating gun is tubing-conveyed down an underbalanced well. The gun is detonated using a drop bar and remote trigger. Foam is almost simultaneously injected and continuously circulated through the wellbore, carrying with it debris from the formation.

Although continuous circulation of foam effectively removes debris from the wellbore in the prior art process, the remote trigger can create un-safe work practices as a result. As well, drop-bars are not considered practical in highly deviated wells since the bar may not reach the bottom. Upchurch relies solely on formation pressure to clean out the wellbore, which can be insufficient in low pressurized formations and can prevent comprehensive elimination of debris from the wellbore. Donovan's method is also dependent on formation pressure to clean out the perforation debris from the wellbore, but is aided by the auger blades. Removal of wellbore debris is not a controlled factor in either case. If debris is not completely removed from the wellbore, it may block perforations, limit production, damage production equipment, or plug the outside or the inside of the production tubing reducing, partially or totally restricting production. In such instances, well clean-out procedures would be repeatedly required at a large expense.

SUMMARY OF THE INVENTION

A process is described for creating openings in a well casing and which substantially and immediately accommodates clean-up and production of debris. In a preferred embodiment, a pressure-actuated perforating gun is fired adjacent a zone in the formation to be perforated for forming openings. Substantially simultaneously, a fluid is continuously injected through an auto-vent near the openings and is circulated up through a wellbore at a sufficient velocity or elutriation rate overcome settling of debris and therefore to remove and lift debris from the formation. Optionally, an uphole foam injection means or port can aid in adjusting the hydrostatic head above the perforating gun. The tubing string extends sufficiently above the wellbore at surface to enable lowering of the tubing string and downhole injection means or port to below the openings for enhanced removal of debris.

In a broad aspect, a process for creating openings between a wellbore and a formation comprises running-in a tubing string into the wellbore to position a perforating gun adjacent a perforating zone, pressurizing to a specific pressure so as to: fire the perforating gun and produce openings between the wellbore and the formation, and to automatically actuate a downhole injection means, and thereafter injecting fluid therethrough at a sufficient velocity or elutriation rate to convey debris from the wellbore by circulating the fluid out through the downhole injection means into the wellbore to surface. It is preferable to lower the tubing string during circulation so as to re-position the location of the downhole injection means to below the openings. Typically thereafter the tubing string is then removed.

In another broad aspect, an apparatus for creating openings between a wellbore and a formation comprises a tubing string in the casing and extending downhole from surface for positioning a perforating gun adjacent a perforating zone and forming an annulus between the tubing string and the casing, a downhole injection port located on the tubing string for injection of fluid at an elutriation rate so as to continuously remove debris from the wellbore, and means to pressurize the tubing for firing the perforating gun and opening the downhole injection means. An uphole foam injection system or means can be located on the tubing string for cleaning out the well and displacing wellbore fluid to create a desired fluid level.

DETAILED DESCRIPTION OF THE PREFERRED EMBODIMENT

Figures 1A, 1B:
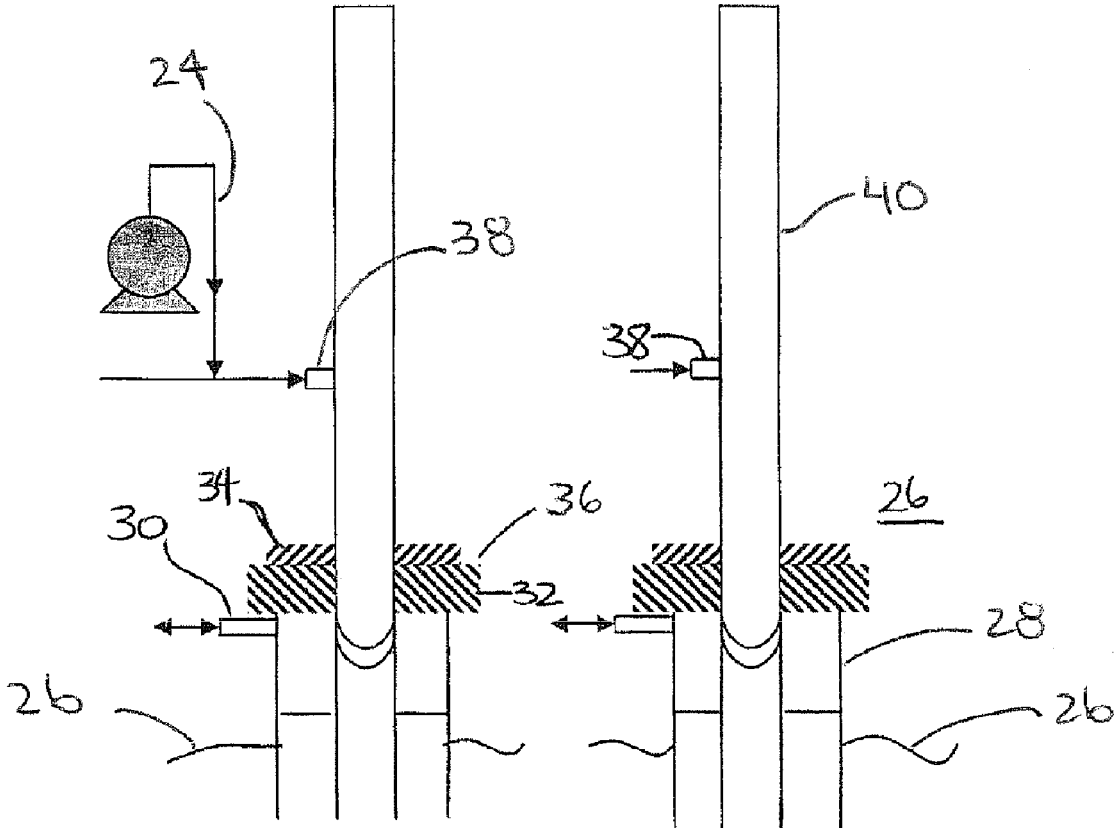
FIGS. 1*a*–1*b* are simplified cross-sections of a wellbore illustrating apparatus run-in on a tubing string for placement of a perforating gun adjacent a formation before firing and for injection fluids, respectively.

With reference to FIG. 1*a*, in a preferred embodiment, it is desirable to create openings 10 in a well casing 12 of a wellbore annulus 14 or wellbore 16 adjacent an underground formation 18. Herein, the openings 10 are more conventionally referred to as perforations 20 which enable communication between the wellbore 16 and the formation 18 through the casing 12. Generally, the perforations 20 are created by firing a perforating gun 22 in the wellbore 16. Debris generally exists in the formation and in the casing which results from operations including drilling or perforation debris, debris from cementing operations, and from mud solids. Naturally occurring debris such as sand, silts or clays can also be present in the formation. In some formations shale, shale chunks, pyrite, coal and other fragmented particles of the formation can be produced.

Figures 2A, 2B, 2C, 2D, 2E, 2F, 2G:
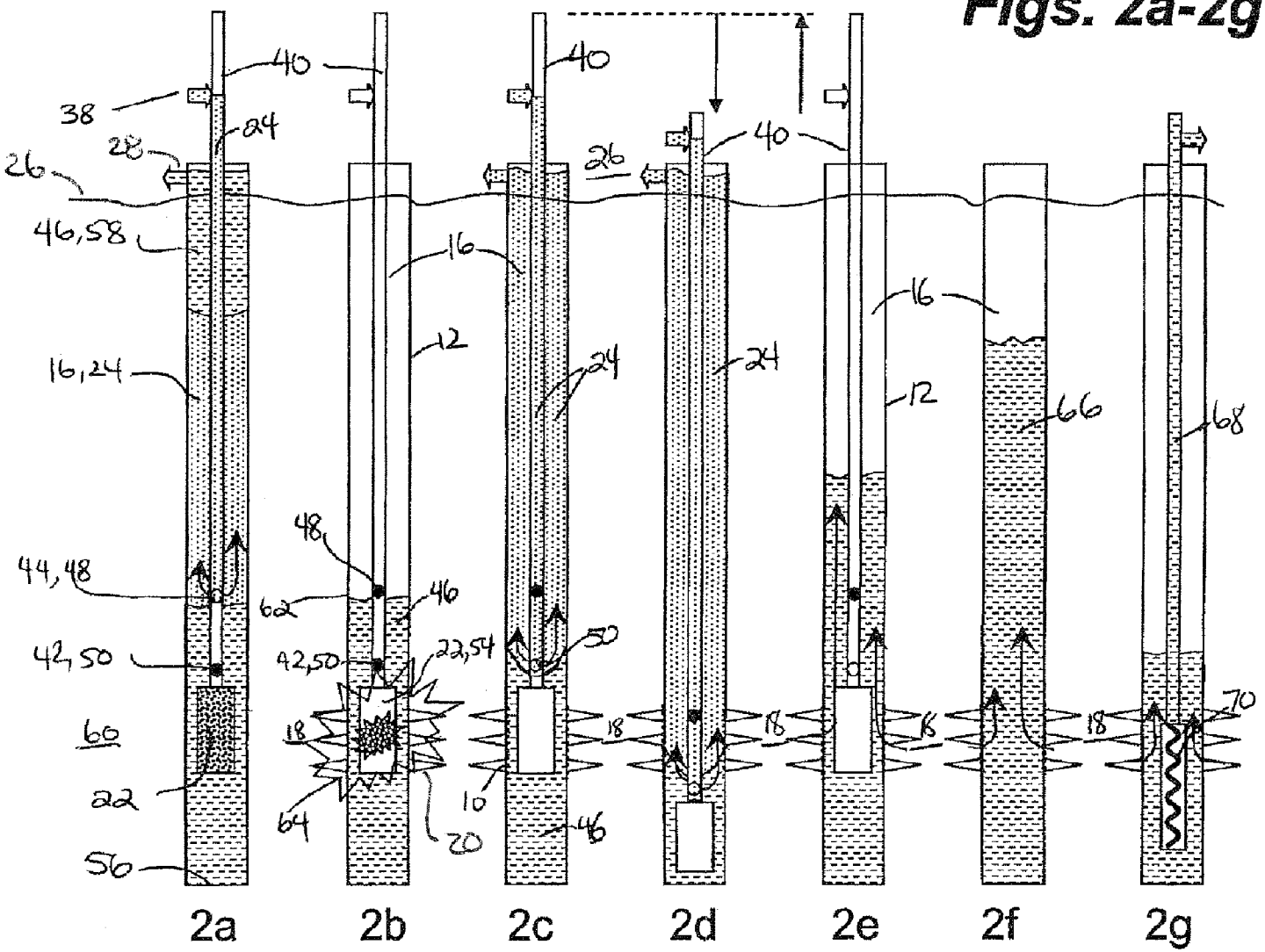
FIGS. 2*a*–2*g* are a series of schematics of stages of the methodology according to one embodiment of the invention.

As shown in FIG. 1*b* and FIGS. 2*c* and 2*d*, debris is removed by substantially immediately commencing to inject and circulate a fluid 24 at sufficient velocities or rates so as to overcome settling velocities of some or substantially all of the debris and lift this debris to surface 26. Such rates are termed herein as elutriation rates.

Fluids 24 are chosen for their elutriation characteristics, such as density, viscosity, and flow velocities as well as how they interact with wellbore fluid 46 and formation fluids 66. The possibility of formation damage should always be considered when choosing a fluid 24. Fluid 24 options can include low density foams, gases, or liquids.

As shown in FIGS. 1*a*, 1*b*, the formation 18 and wellbore 16 are prepared for an aggressive completion or stimulation techniques using a preferred embodiment of the present invention. A suitable wellhead configuration comprises a spool 28 having a fluid and debris outlet 30 providing communication with the wellbore 16, a blow-out preventor (BOP) 32 and a pack-off 34 at a wellhead 36, and a fluid injection inlet 38.

With reference also to FIGS. 2*a*–2*g* and FIGS. 3*a*–1*c*, a completion is prepared comprising a tubing string 40 fit at its distal end with the pressure-actuated perforating gun 22 set to fire at a specific pressure. A downhole injection means or port 42 is also set to open or burst at that specific pressure. The downhole injection port 42 is located uphole of the perforating gun 22. Preferably the downhole injection port 42 is a tubing drain in combination with a firing head of the gun 22. An example of such a device is the Chameleon, Absolute Pressure Vented Firing Head available from Explosives Limited, Canada. The firing head utilizes fluid pressure to actuate a piston, which actuates the gun and which opens a vent sleeve, which opens the downhole injection port 42.

The tubing string 40 is made up with conventional components to assist in establishing a tubing tally and the like.

The apparatus enables injection of fluid 24 for lifting debris from the wellbore 16 such as when there is not sufficient formation production volume or pressure to remove the debris or where the debris has a high enough density to be unaffected by usual flow of formation production fluids. Circulation of a suitable fluid 24 can be implemented providing enhanced lift. Such fluid 24 is circulated at sufficient velocity, viscosity and density or elutriation conditions and rates to remove the debris. Thus it is understood that the fluid removing debris being the fluid flowing up the wellbore to surface can comprise injected fluid 24 or a combination of production fluid from the formation and injected fluid 24.

Generally, a fluid level 62 is established above the perforating gun 22. Circulation of fluid 24 is established through the fluid injection inlet 38 at the surface 26 and wellbore fluid 46 and fluid 24 are recovered through the spool 28 at the surface 26.

Figure 3A:
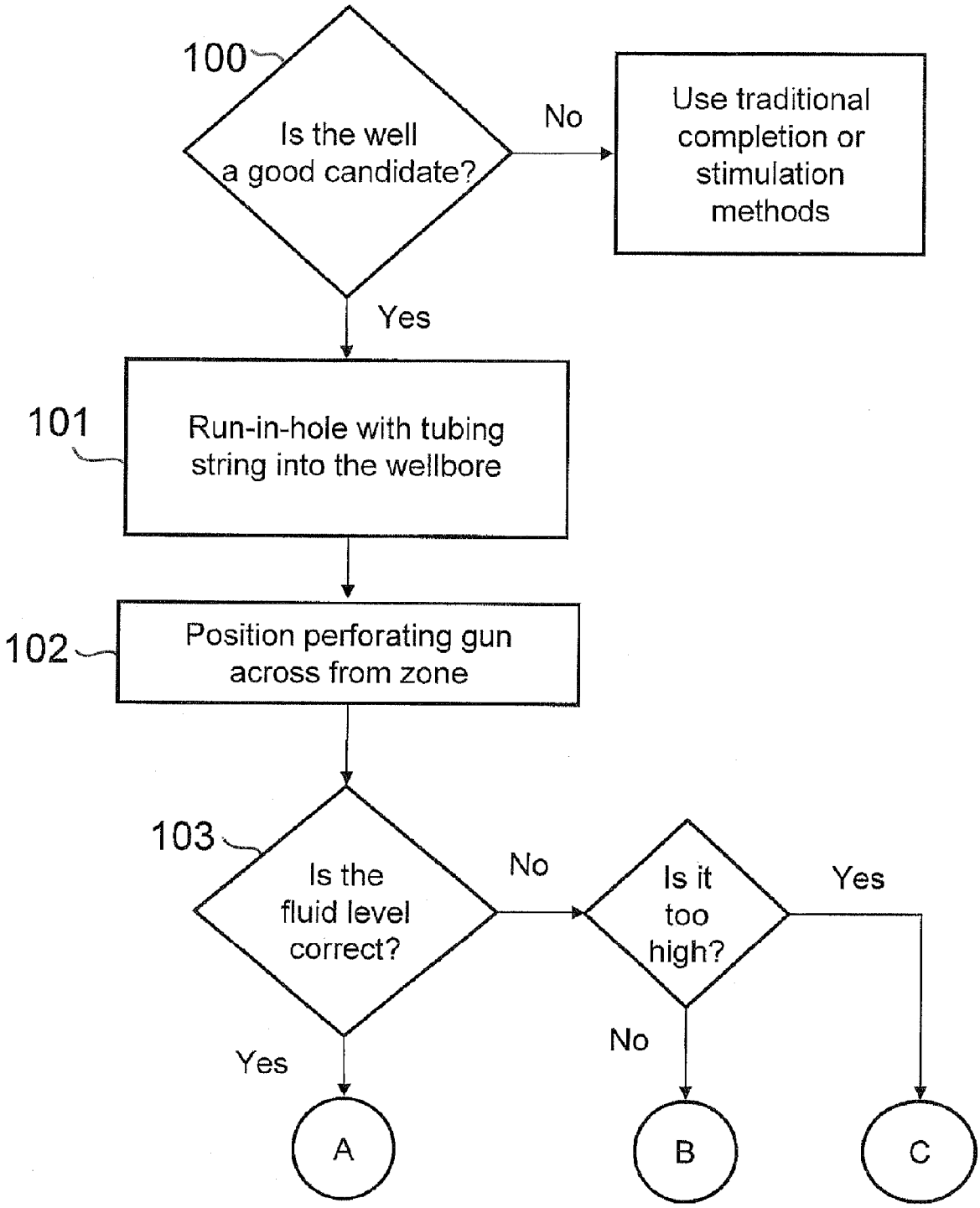
FIGS. 3*a*–3*c* are flowcharts of some steps of an embodiment of the invention according to FIGS. 2*a*–2*g* and illustrating some optional embodiments.

At FIG. 2*a* and step 100 of FIG. 3*a* (FIG. 3*a*,100), if the well is a good candidate for the operation, the tubing string 40 is run in FIG. 3*a*,101 and preferably positioned FIG. 3*a*,102 in the wellbore 16 such that the perforating gun 22 is located across from a zone 60 to be perforated and is covered by some wellbore fluid 46. Of course, safe procedures must be used in a completions operation or stimulation technique including proper tubing string entry techniques. The tubing string 40 is packed off above the wellbore 16, as shown in FIGS. 1*a*,1*b*.

Figure 3B:
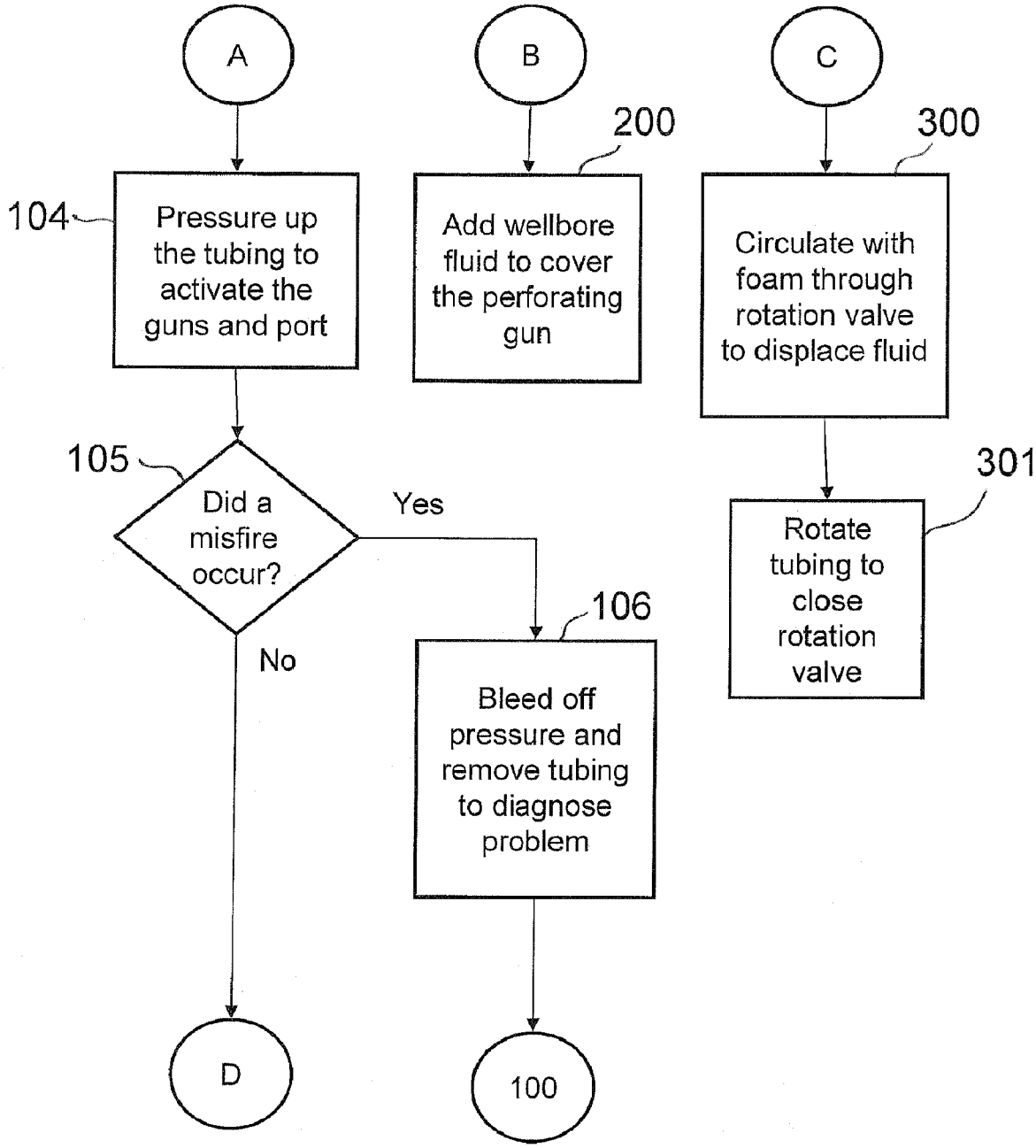

As shown in FIG. 2*b* and FIG. 3*b* at A, if the desired fluid level 62 exists FIG. 3*a*,103, the tubing string 40 is pressurized using pressurizing means and the perforating gun is actuated. The fluid level 62 creates a minimum hydrostatic pressure above the perforating gun 22 allowing maximum inflow from the formation once the casing 12 and formation 18 is perforated, but covers the perforating gun 22 to keep it from splitting.

The tubing string 40 is pressurized FIG. 3*b*,104 to a first and specific pressure for actuating a firing head 54 of the perforating gun 22 and forming perforations 20. A pump, or optionally, pressurized gas may be used to apply pressure in the tubing string 40. Activation of the perforating gun 22 is not affected by its orientation in the well casing 12. An explosion 64 creates perforations 20 in the well casing 12 between the wellbore 16 and the reservoir or formation 18 for recovery of formation fluids 66.

The specific pressure, such as due to the firing of the firing head 54 of the perforating gun 22, also opens the downhole injection port 42 enabling fluid communication therethrough with the wellbore 16.

At FIG. 3*b*,105 if a misfire occurs, or the downhole injection port 42 does not open, or opens but the pressure activated firing head 54 does not fire, then the tubing string 40 needs to removed and the problem diagnosed FIG. 3*b*,106. If required, downhole injection port 42 and firing head 54 are serviced or replaced. The tubing string 40 is run in hole and the process starts again.

As shown at FIG. 2*c*, circulation of the fluid 24 conveys or aides the conveyance of the debris up the wellbore 16 with any production fluids to the surface 26 for removal of substantially all debris.

Turning to FIG. 2*d* and to FIG. 3*c*,108, when circulating fluid 24 and for more effective removal of the debris, the tubing string 40 is slowly lowered so that downhole injection port 42 is below the perforations 20. At FIG. 2*e* and FIG. 3*c*,109, it can be desirable in some instances to stroke, or lower and raise, the tubing string 40 periodically to prevent lodging of the debris and sand flowing into the wellbore 16 between the tubing string 40 and well casing 12. This action can continue until sufficient debris has been successfully removed.

Once the operation is complete and sufficient debris has been removed from the wellbore 16, the well's productivity thereafter is increased.

Figure 3C:
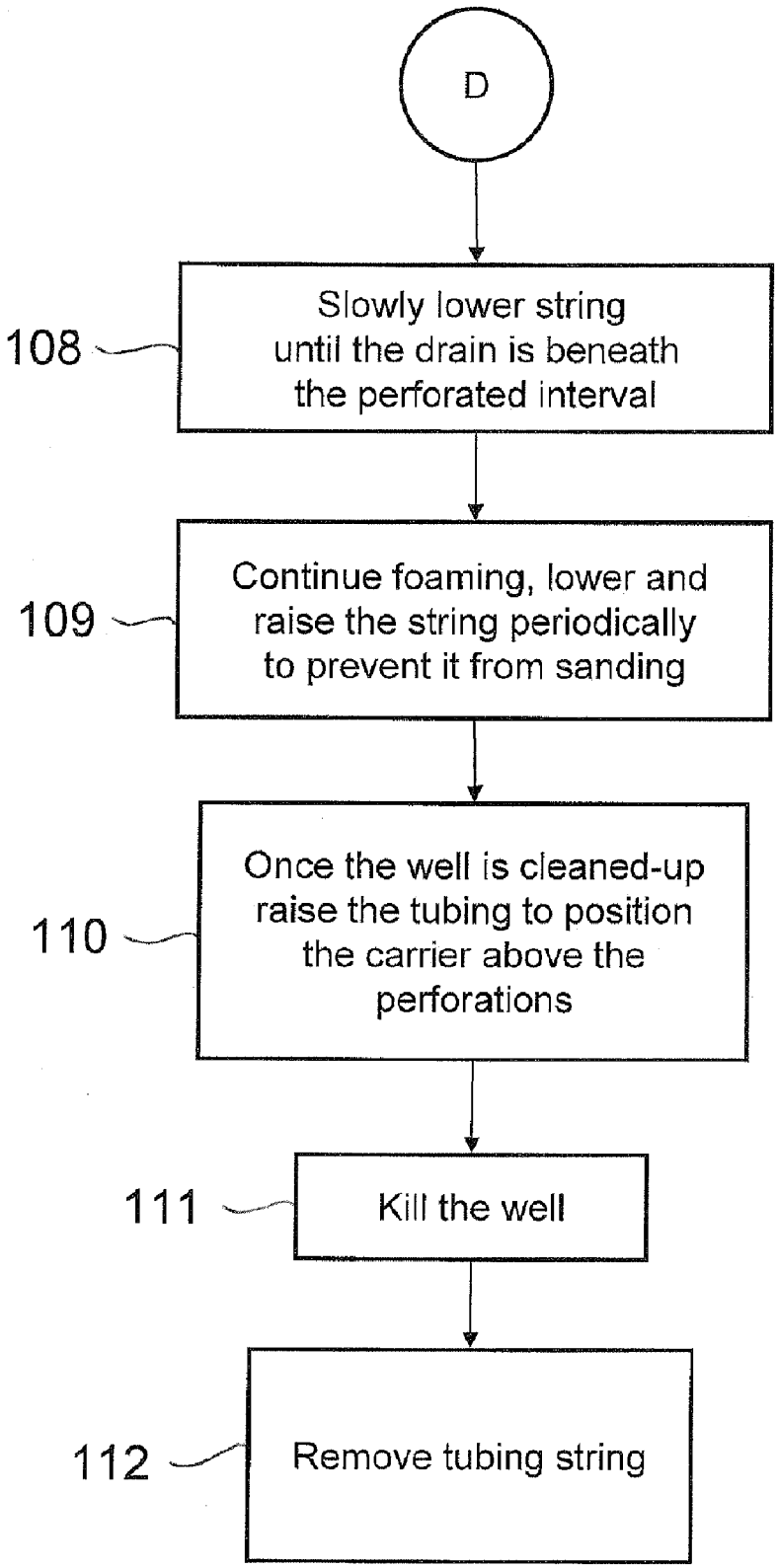

At FIG. 2*e* and FIG. 3*c*,110 the tubing string 40 is then raised to elevate the perforating gun 22 above the perforations 20. At FIG. 2*f* and FIG. 3*c*,111, one of a variety of techniques can be used to apply sufficient hydrostatic head to kill the well before safely pulling FIG. 3*c*,112 the tubing string 40 from the wellbore 16. Typically the methodology for killing the well is tailored to the particular well and can include simply diminishing fluid 24 circulation to allow formation fluid 66 production to fill the annulus 14 and kill the well or to more aggressively load up the wellbore with suitable wellbore fluid 46.

At FIG. 2*g*, and as an objective of rehabilitating the formation 18, a production string 68 with a production pump 70 can be run in to re-establish production from the treated well.

In an alternate embodiment, and returning at FIG. 3*a*, 103 if the fluid level 62 is deemed inappropriate, and as shown in FIG. 2*b* the hydrostatic head may be adjusted. If the fluid level is too low FIG. 3*a*,103,B, conventional wellbore fluid 46 can be added FIG. 3*b*,200 to the wellbore 16 for increasing or creating an optimal fluid level 62 by adding wellbore fluid 46 down the annulus.

In another embodiment of the invention, at FIGS. 2*a*,2*b* and FIG. 3*a*,103,C it may be desirable to reduce the hydrostatic head above the perforating gun 22. An optional uphole injection means or port 44 is located uphole of the downhole injection port 42. The uphole injection port 44 is preferably a conventional rotational valve 48. The rotational valve 48 is strategically located to establish the desired fluid level 62 uphole of the downhole injection port 42 and the perforating gun 22.

In FIG. 2*a* and FIG. 3*a*,101, the tubing string 40 is lowered into the wellbore 16 with the rotational valve 48 in the open position. If the well has not been previously cleaned out, or if too much hydrostatic pressure exists, at FIG. 3*a*,102 a well depth 56 is tagged and low density foam or suitable fluid can be circulated through the rotational valve 48 to displace any wellbore fluid 46 to create the desired fluid level 62. The rotational valve 48 can be positioned at other locations in the wellbore 16 and fluid 24 circulated FIG. 3*b*,300 to remove wellbore fluid 46 above the rotational valve 48, resulting in the desired fluid level 62. Thereafter, the perforating gun 22 may need to be re-positioned to align with the zone 60 to be perforated. Accordingly, at FIG. 2*b* and FIG. 3*b*,301, the tubing is rotated to close the rotational valve 48, discontinuing any foam injection and creating a continuously sealed tubing string 40 for pressurizing.

The preferred fluid 24 is low density foam. Inherently, foam has a high viscosity at low shear rates making it extremely useful as a circulating medium in low pressure reservoirs. These properties minimize fluid loss to the formation and reduce needed annular velocities yet provide sufficient debris elutriation with high lifting capability at minimum circulating pressures. Circulation conditions, including foam generated with natural gas or nitrogen instead of air, can be used to clean out higher pressure wells.

Alternatively, production fluids can also be used. A variety of natural and process additives or polymers are available to increase the lifting, carrying and suspending capability of the fluid.

It will be readily apparent to those skilled in the art that many variations, application, modifications and extensions of the basic principles involved in the disclosed embodiments may be made without departing from its spirit or scope.

As suggested in FIG. 3*a* at 100, some wells are better candidates than others for this process, and while this process was developed for the criteria described below, is not limited to these applications which include:

Sand production initiation in stubborn sand formations for cold heavy oil production with sand, Known drilling damage completions, Enhanced and rapid drainage geometry development, and Enhanced initial and cumulative production.

What is claimed is:

1. A process for creating openings between a wellbore and a formation comprising:

running-in a tubing string into the wellbore to position a perforating gun adjacent a perforating zone;

pressurizing the tubing string to a specific pressure to actuate the perforating gun and produce openings between the wellbore and the formation, and to actuate a downhole injection port adjacent the perforating gun; and injecting fluid through the downhole injection port for recovery out of the wellbore, so that a rate of fluid up the wellbore is sufficient to convey debris therewith.

2. The process of claim 1 wherein prior to actuating the perforating gun further comprising:

opening an uphole injection port located on the tubing string uphole of the downhole injection port; and adjusting the hydrostatic head above the perforating gun.

3. The process of claim 2 wherein the adjusting of the hydrostatic head above the perforating gun further comprises circulating low density fluid through the uphole injection port for displacing wellbore fluid.

4. The process of claim 2 wherein the adjusting of the hydrostatic head above the perforating gun further comprises injecting produced fluid through the uphole injection port.

5. The process of claim 2 further comprising closing the uphole injection port after the hydrostatic head above the perforating gun has been adjusted.

6. The process of claim 1 wherein after actuating the downhole injection port further comprising lowering the downhole injection port from uphole of the openings to a location downhole of the openings.

7. The process of claim 6 wherein the injecting of fluid is performed while lowering the downhole injection port from uphole of the openings to a location downhole of the openings.

8. The process of claim 1 wherein the injected fluid is a low density foam.

9. The process of claim 1 further comprising stroking the tubing string to periodically alternate the downhole injection port between a location downhole of the openings to a location uphole of the openings.

10. The process of claim 1 wherein after the debris has been conveyed up the wellbore further comprising killing the wellbore and removing the tubing string from the killed wellbore.

11. An apparatus for creating openings through casing between a wellbore and a formation comprising:

a tubing string extending downhole in the casing to the formation and forming an annulus therebetween;

a perforating gun at the downhole end of the tubing string and actuable at a specific pressure; and a downhole injection port located on the tubing string adjacent the perforating gun and being pressure-actuable at the specific pressure, wherein, when the tubing is pressurized to the specific pressure:

the perforating gun is actuated for forming openings in the casing, and the downhole injection port is opened to enable circulation fluid from the tubing, into and up the annulus so as to continuously remove perforation debris from the wellbore.

12. The apparatus of claim 11 wherein the circulation fluid is a low density foam.

13. The apparatus of claim 11 where the downhole injection port is located uphole of the perforating gun.

14. The apparatus of claim 11 where the downhole injection port is a tubing drain actuable simultaneously with the perforating gun.

15. The apparatus of claim 11 further comprising a pump at surface for pressurizing the tubing string to the specific pressure.

16. The apparatus of claim 11 further comprising means for applying a compressed or pressurized gas for pressurizing the tubing string to the specific pressure.

17. The apparatus of claim 11 further comprising an uphole injection port for adjusting hydrostatic head above the perforating gun.

18. The apparatus of claim 17 where the uphole injection port is located uphole of the downhole injection port.

19. The apparatus of claim 17 where the uphole injection port is a rotational valve.

* * * * *